US005393022A

United States Patent [19]

Palumbo

[11] Patent Number: 5,393,022

[45] Date of Patent: Feb. 28, 1995

[54] MULTI-COMPARTMENT DEBRIS AND LEAF BAG HOLDER AND ASSEMBLY

[76] Inventor: Dominick P. Palumbo, 88 Lyman Ave., N. Patchogue, N.Y. 11772

[21] Appl. No.: 37,555

[22] Filed: Mar. 26, 1993

[51] Int. Cl.[6] ..... B65B 67/12

[52] U.S. Cl. ..... 248/95; 248/99

[58] Field of Search ..... 248/95, 97, 99, 101, 248/146; 141/108, 314, 316; 15/257.1, 257.9

[56] References Cited

U.S. PATENT DOCUMENTS

| | | | |
|---|---|---|---|
| 3,754,785 | 8/1973 | Anderson | 248/99 X |
| 3,893,615 | 7/1975 | Johnson | 248/95 X |
| 4,787,584 | 11/1988 | Palmer | 248/99 |
| 4,805,858 | 2/1989 | Taylor | 248/99 |
| 4,832,292 | 5/1989 | Beckham | 248/99 |
| 4,981,274 | 1/1991 | McVay et al. | 248/97 X |
| 5,000,406 | 3/1991 | Petersen | 248/99 |
| 5,031,277 | 7/1991 | Coker | 141/314 X |
| 5,040,754 | 8/1991 | Dearman | 248/97 |
| 5,083,731 | 1/1992 | Fullilove | 141/316 X |

*Primary Examiner*—Alvin C. Chin-Shue
*Assistant Examiner*—Derek J. Berger
*Attorney, Agent, or Firm*—Galgano & Burke

[57] ABSTRACT

A portable, multi-compartment garden debris and leaf bag holder and assembly includes a plurality of flexible bags and a plurality of adjacent, rectangular frame supports each comprising a top member, bottom member and a pair of spaced-apart side members interconnecting the top and bottom members which together define a central opening therethrough. Each of the frame supports demountably supports a flexible bag having peripheral edges defining an open end with its open end in communication with the central opening thereof. The frames are supported in an upright manner on a ground surface.

9 Claims, 2 Drawing Sheets

MULTI-COMPARTMENT DEBRIS AND LEAF BAG HOLDER AND ASSEMBLY

BACKGROUND OF THE INVENTION

The present invention relates to a multi-compartment debris and leaf bag holder and assembly. More particularly, it relates to such a holder and assembly for holding a plurality of plastic leaf bags with their open ends spread apart and wide open and disposed in a row so as to facilitate the loading of leaves and other garden debris therethrough and into the interior of the bags.

Various leaf bag holders for spreading apart the openings of plastic leaf bags and the like are known in the art to facilitate filling of the bag with leaves and other garden debris (see, e.g., U.S. Pat. Nos. 3,754,785; 4,440,430; 4,530,533; 4,832,292; and 5,083,731). A non-portable, multi-compartment refuse container utilizing plastic bags as conventional garbage cans is also known (see U.S. Pat. No. 3,893,615). However, these leaf bag holders are only intended for holding open a single bag which requires the user to constantly load empty and unload full bags one after the other. In addition, many of the leaf bag holders are cumbersome and difficult to use. Moreover, so far as is known, none of these devices allows one to fill a plurality of bags at the same time in a convenience manner while sweeping or raking and without requiring lifting of the leaves and debris into the mouth of an upright bag or container.

Accordingly, it is an object of the present invention to provide a novel, portable, multi-compartment garden debris and leaf bag holder and assembly which is simple in design, easy to use and economical to fabricate.

It is also an object of the present invention to provide such a novel holder and assembly which will support a plurality of bags in a row and in an open position to allow one to rake, sweep or broom leaves, grass, sweepings and other garden debris directly into the bags.

It is a more particular object of the present invention to provide such a novel holder and assembly which may be quickly assembled and disassembled on site and which allows for easy mounting of empty bags and removal of full bags thereby saving time and labor.

SUMMARY OF THE INVENTION

Certain of the foregoing and related objects are readily attained according to the present invention by the provision of a portable, multi-compartment garden debris and leaf bag holder which includes a plurality of adjacent, rectangular frame supports each comprising a top member, bottom member and a pair of spaced-apart side members interconnecting said top and bottom members which together define a central opening therethrough. Each of the frame supports has means for demountably supporting a flexible bag having peripheral edges defining an open end with its open end in communication with the central opening thereof. Means are provided for releasably securing said frame supports in an upright manner on a ground surface.

Preferably, the holder additionally includes means for releasably coupling adjacent frame supports together. Most desirably, the means for demountably supporting comprises a pair of cooperating and opposing L-shaped flanges formed on a rear side of said side members which define channels configured and dimensioned for slidable receipt of the peripheral edges of a flexible bag therein. Most advantageously, the means for releasably securing comprises at least one spike depending from the bottom member of each frame.

In a preferred embodiment of the invention, the means for releasably coupling comprises hook and eye coupling elements secured to the side members of said frames and the top members each have a finger slot formed therethrough. In addition, the frame members are made of plastic.

In a particularly preferred embodiment, the holder includes a pair of guide flaps each of which is releasably coupled to one of the two outermost frame supports. The guide flaps each have means for releasably securing the guide flaps in an upright manner and at a desired angle of orientation relative to the frame supports so as to guide debris into the openings thereof. The means for releasably securing said guide flaps advantageously comprises removable spikes.

Certain of the foregoing and related objects are also attained in a portable, multi-compartment garden debris and leaf bag holder and assembly which includes a plurality of flexible bags having peripheral edges defining an open end in combination with a garden debris and leaf bag holder as previously described. Preferably, the bags have stiffened peripheral edges slidably receivable in the channels of the L-shaped flanges.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
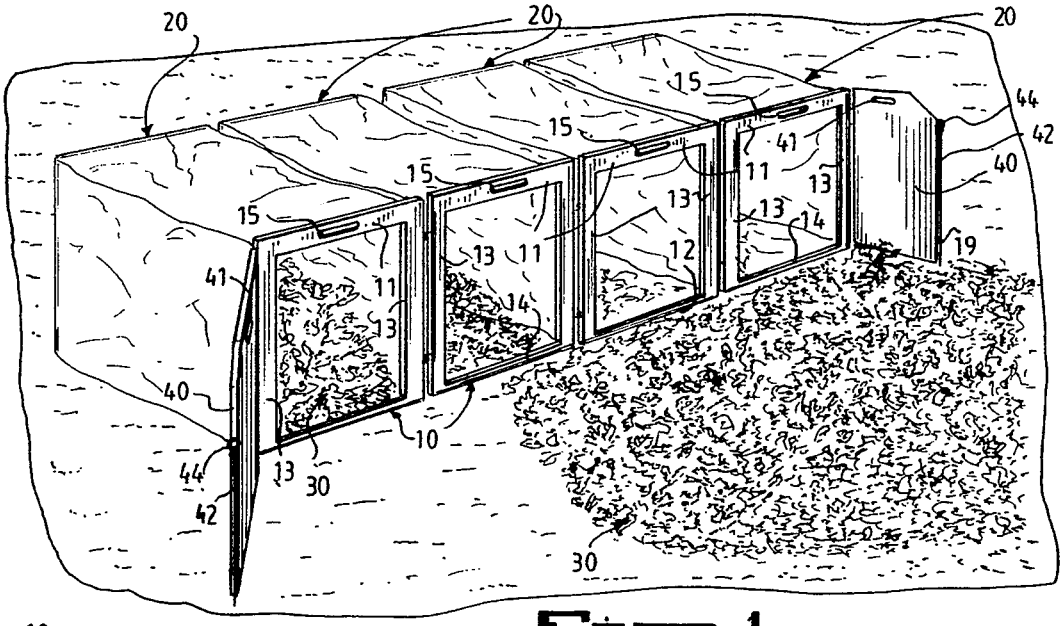
FIG. 1 is a front, side and top perspective view of the novel garden debris and leaf bag holder and assembly embodying the present invention showing the same in use.
Figure 2:
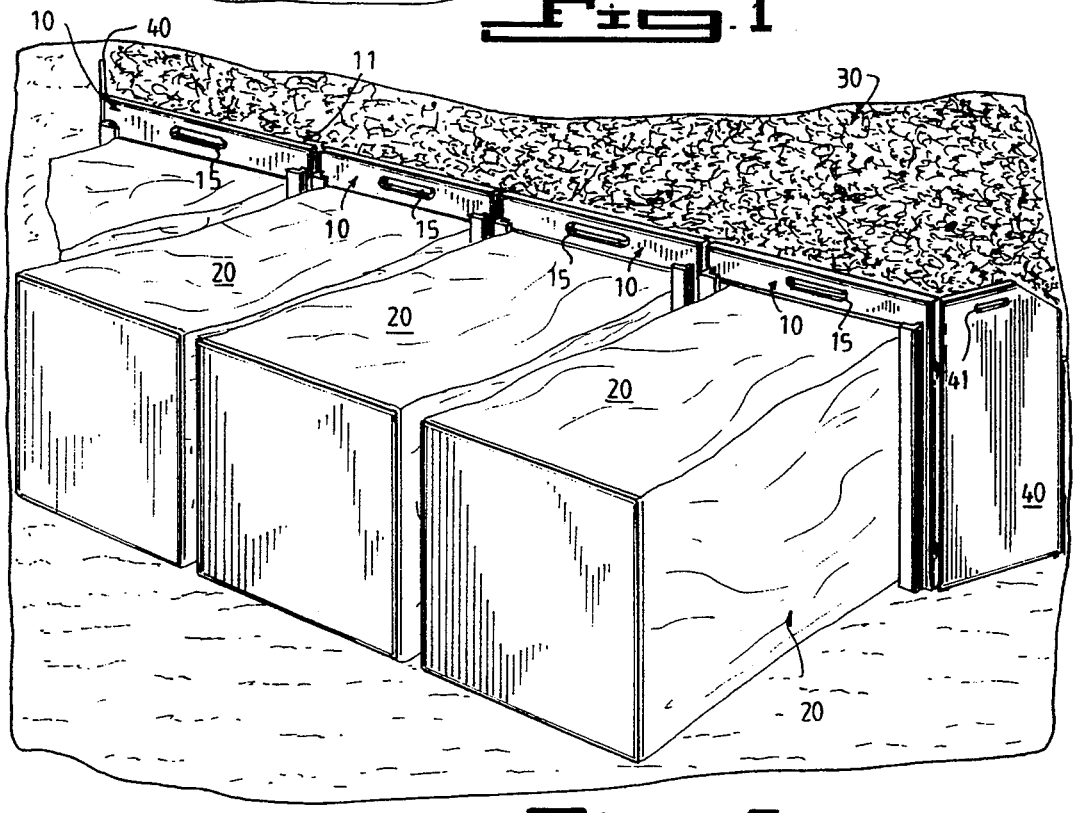
FIG. 2 is a fragmentarily-illustrated, enlarged rear, side and top perspective view of the holder and assembly shown in FIG. 1.
Figure 3:
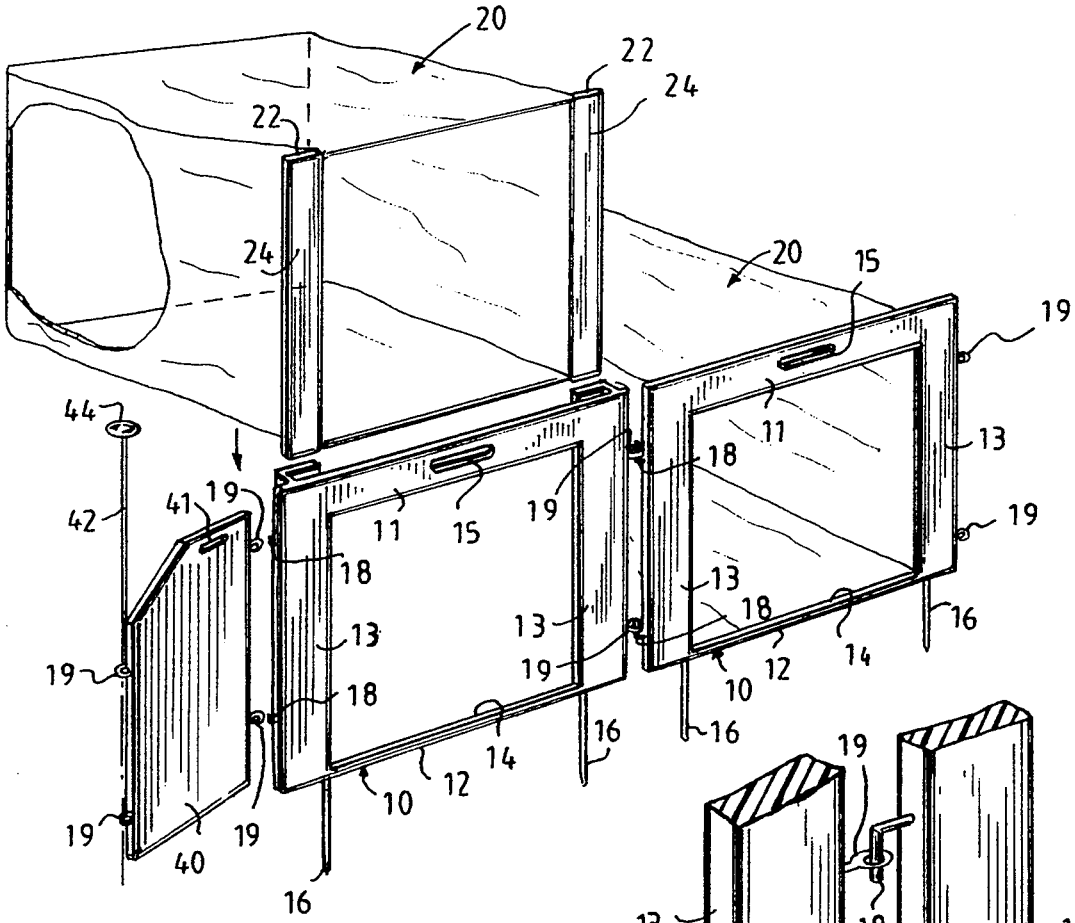
FIG. 3 is a fragmentarily-illustrated, front, side and top perspective view of the holder and assembly showing a removable bag being inserted into the frame support of one compartment.

Referring now in detail to the drawings and, in particular, FIGS. 1–3 thereof, therein illustrated is a novel portable multi-compartment garden debris and leaf bag holder and assembly which includes a multiplicity of closely adjacent rectangular frame supports generally designated 10 which are positioned in an upright manner in a row. Frame supports 10, in turn, each support the open end or mouth of a preferably plastic garden or leaf bag 20 so as to allow one to sweep or rake leaves and other garden debris 30 directly thereinto.

Figure 4:
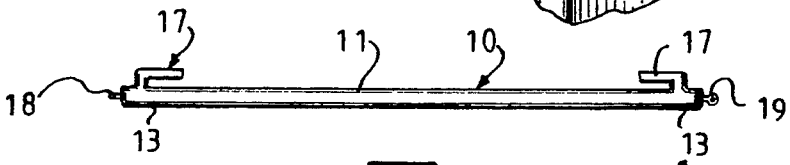
FIG. 4 is a plan view of the frame support of the holder.

As seen best in FIG. 3, each rectangular frame support 10 has a top member 11, a bottom member 12, and a pair of spaced apart side members 13 interconnecting the top and bottom member 11, 12 and defining therewith a large, central rectangular opening 14. Top members 11 each have a hand or finger slot 15 formed therein to facilitate lifting and transport of the frame supports. A pair of spaced-apart spikes 16 depend from the bottom edge of bottom member 12 to allow mounting of the frames in an upright manner in the ground. As shown clearly in FIG. 4, extending the length of the rear side of side members 13 are opposing and cooperating L-shaped flanges 17, the purpose for which will be described in greater detail hereinafter.

Figure 5:
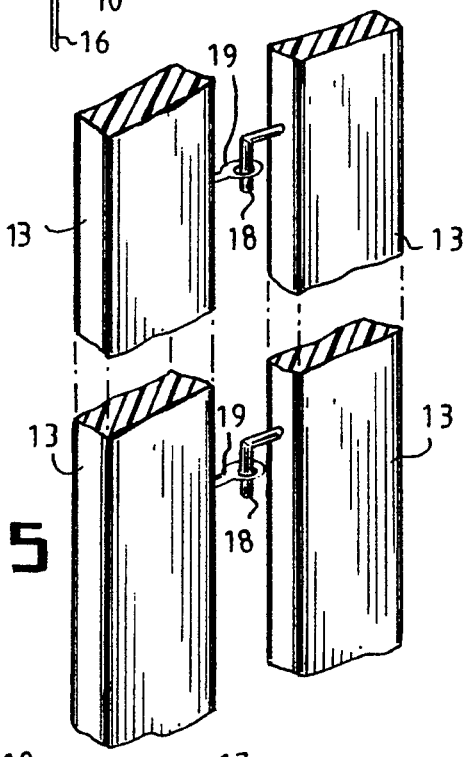
FIG. 5 is an enlarged, fragmentarily-illustrated, perspective view of two adjacent frame supports releasably secured together by a hook and eye connector.

As can be seen more clearly in FIG. 5, adjacent rectangular frames are releasably coupled together by cooperating paired hook and eyelet elements 18, 19 mounted in the side edges of side members,.13 of frame supports 10. Preferably, two spaced-apart pairs of hook and eyes 18, 19 are used to couple adjacent frame supports 10 together. As shown in FIGS. 1–3, the outermost frame supports are each releasably coupled via hook and eyelets 18, 19 to a guide flap 40 which is used to guide debris to the openings 14 of the frame supports 10 and which also provides additional support to the frame supports 10. A hand grip slot 41 is provided adjacent the top edges of guide flaps 40 and the outer edge of guide flaps 40 are provided with a pair of spaced apart eyelets 19 through which a removable spike 42 having a handle grip 44 is insertable through and into the ground to fix the flap 40 at a desired guidance angle relative to the frame supports 10.

As seen best in FIG. 3, the plastic flexible bags 20 are preferably provided with stiffening ribs or flanges 22 made of, e.g., cardboard or rigid plastic which support the peripheral edges 24 of the bag 20 defining its open end; although only the lateral peripheral edges are shown with stiffening ribs 22, it should be noted that the top and bottom peripheral edges of the bag 20 are also relatively rigid and could also be provided with stiffening ribs 22 to ensure that the bag maintains its open and correct position when inserted into the frame supports 10. These peripheral edges 24 and supporting stiffening ribs 22 are slidably receivable within the channels define by the L-shaped flanges 17 so as to align the open end of the bags 20 with the central opening 14 of the frame supports 10. Although the bags 20 are shown with a rectangular shape, it should be appreciated that round collapsible bags could also be used preferably employing stiffening ribs 22, as well.

The multi-compartment bag holder could be initially compactly stored in one's garage or shed, hung on hooks, for example. It can easily be installed on site by the homeowner by simply inserting the spikes 16 into the ground and by interlocking adjacent frame supports via the hooks and eyelets 18, 19. The frame supports could be arranged in a straight row or could be angled with respect to one another to define a circular arc. The guide flaps 40 would be connected to the outermost frame supports via hooks 18 and eyelets 19 and following their positioning at a desired angle of orientation, the removable spikes 40 would be inserted through eyelets 19 into the ground to fix their position. Then bags 20 would be inserted into the frame supports 10 via slidable receipt of their peripheral edges 24 and stiffening ribs 22 in the channels of flanges 17 of frame supports 10. The assembly (i.e., holder and bags) would then be ready fop use to permit filling with leaves or other garden debris as shown in FIG. 1. The bags 20 would be filled by simply raking or sweeping the debris directly into the mouths of the bags, aided by the guide flaps 40 and the close spacing of frame supports 10 which minimizes debris from slipping past therebetween. When the bags are full, the bags are simply lifted out of the frame supports and then closed and disposed of.

Various modifications may be made as will be apparent to those skilled in the art. For example, although the frame supports are preferably joined together, it may be possible for certain applications to simply mount them adjacent to one another. In addition, while hook and eyelet elements are preferably used, other conventional coupling elements may be employed. Furthermore, although the frame supports are preferably made of plastic, they could be made of wood, metal or a composite material. Moreover, although disposable plastic leaf bags are preferably employed, paper bags could also be used. In addition, the number of spikes employed for the holders can be varied and the guide flaps could also be provided with additional support spikes similar to that provided for the frame supports.

Accordingly, while only one embodiment of the present invention has been shown and described, it is to be understood that many changes and modifications may be made thereunto without departing from the spirit and scope of the invention as disclosed herein.

What is claimed is:

1. A portable, multi-compartment garden debris and leaf bag holder comprising:

a plurality of adjacent, rectangular frame supports each comprising a top member, bottom member and a pair of spaced-apart side members interconnecting said top and bottom members which together define a central opening therethrough, each of said frame supports having means for demountably mounting a flexible bag having peripheral edges defining an open end with its bags open end in communication with said central opening thereof;

means for releasably securing said frame supports in an upright manner on a ground surface; and means for releasably coupling adjacent frame supports together.

2. The portable, multi-compartment garden debris and leaf bag holder according to claim 1, wherein said means for demountably mounting comprises a pair of cooperating and opposing L-shaped flanges formed on a rear side of said side members which define channels configured and dimensioned for slidable receipt of the peripheral edges of a flexible bag therein.

3. The portable, multi-compartment garden debris and leaf bag holder according to claim 1, wherein said means for releasably securing comprises at least one spike depending from the bottom member of each frame.

4. The portable, multi-compartment garden debris and leaf bag holder according to claim 1, wherein said means for releasably coupling comprises hook and eye coupling elements secured to the side members of said frames.

5. The portable, multi-compartment garden debris and leaf bag holder according to claim 1, wherein said top members each have a finger slot formed therethrough.

6. The portable, multi-compartment garden debris and leaf bag holder according to claim 1, wherein said plurality of frame supports include two outermost frame supports and wherein said holder additionally includes a pair of guide flaps each of which is releasably coupled to one of the two outermost frame supports, said guide flaps each having means for releasably securing said guide flaps in an upright manner and at a desired angle of orientation relative to said frame supports so as to guide debris into the openings of said frame supports.

7. The portable, multi-compartment garden debris and leaf bag holder according to claim 6 wherein said means for releasably securing said guide flaps comprises removable spikes.

8. The portable, multi-compartment garden debris and leaf bag holder according to claim 1, wherein said frame members are made of plastic.

9. A portable, multi-compartment garden debris and leaf bag holder comprising:

a plurality of adjacent, rectangular frame supports each comprising a top member, bottom member and a pair of spaced-apart side members interconnecting said top and bottom members which together define a central opening therethrough, each of said frame supports having means for demountably mounting a flexible bag having peripheral edges defining an open end with its bags open end in communication with said central opening thereof, said plurality of frame supports including two outermost frame supports;

means for releasably securing said frame supports in an upright manner on a ground surface; and a pair of guide flaps, each of which is releasably coupled to one of the two outermost frame supports, said guide flaps each having means for releasably securing said guide flaps in an upright manner and at a desired angle of orientation relative to said frame supports so as to guide debris into the openings of said frame supports, said means for releasably securing said guide flaps comprising removable spikes.

* * * * *